US007165982B2

(12) United States Patent
Häfele et al.

(10) Patent No.: US 7,165,982 B2
(45) Date of Patent: Jan. 23, 2007

(54) CONNECTOR WITH DOUBLE-ACTION LATCH FOR A DIESEL-ENGINE GLOW PLUG

(75) Inventors: Jürgen Häfele, Hohenems (AT); Werner Jäger, Hohenems (AT)

(73) Assignee: Hirschmann Automotive GmbH, Brederis (AT)

( * ) Notice: Subject to any disclaimer, the term of this patent is extended or adjusted under 35 U.S.C. 154(b) by 0 days.

(21) Appl. No.: 11/390,959

(22) Filed: Mar. 28, 2006

(65) Prior Publication Data

US 2006/0223354 A1 Oct. 5, 2006

(30) Foreign Application Priority Data

Mar. 29, 2005 (DE) ..... 10 2005 014 203

(51) Int. Cl.
*H01R 13/44* (2006.01)

(52) U.S. Cl. ..... 439/127

(58) Field of Classification Search ..... 439/125–128, 439/352

See application file for complete search history.

(56) References Cited

U.S. PATENT DOCUMENTS 3,885,851 A * 5/1975 Bennett ..... 439/352
3,953,098 A * 4/1976 Avery et al. ..... 439/258
4,017,139 A * 4/1977 Nelson ..... 439/352
4,533,194 A * 8/1985 Boichut et al. ..... 439/347
5,195,905 A * 3/1993 Pesci ..... 439/352
5,344,328 A * 9/1994 Suggs ..... 439/127
5,785,545 A * 7/1998 Holt ..... 439/352
5,997,333 A * 12/1999 Konda et al. ..... 439/352
6,056,577 A * 5/2000 Blanchet ..... 439/352
6,093,043 A * 7/2000 Gray et al. ..... 439/352
6,183,904 B1 * 2/2001 Kuboshima et al. ..... 429/178
6,193,528 B1 * 2/2001 Rea et al. ..... 439/127
6,361,348 B1 * 3/2002 Hall et al. ..... 439/352
6,539,905 B1 * 4/2003 Estacio et al. ..... 123/145 A
6,568,950 B1 * 5/2003 Rudoy et al. ..... 439/352
6,691,660 B1 * 2/2004 Silva et al. ..... 123/179.6
6,692,286 B1 * 2/2004 De Cet ..... 439/352
6,695,636 B1 * 2/2004 Hall et al. ..... 439/352
6,709,289 B1 * 3/2004 Huber et al. ..... 439/578
6,884,105 B1 * 4/2005 Turck et al. ..... 439/352
7,059,288 B1 * 6/2006 Merrick et al. ..... 123/145 A
2004/0137778 A1 * 7/2004 Mattheeuws et al. ..... 439/352
2004/0237922 A1 * 12/2004 Merrick et al. ..... 123/145 A

* cited by examiner

*Primary Examiner*—Ross Gushi
(74) *Attorney, Agent, or Firm*—Andrew Wilford

(57) ABSTRACT

A plug-in connector for a diesel-engine glow plug has a housing centered on an axis and fittable with the glow plug and a plurality of contacts in the housing. A first latch on the housing is displaceable when the housing is fitted to the glow plug between an unlocked position permitting the housing to be installed on and removed from the glow plug and a locked position for fixing the housing to the glow plug. A second latch on the housing is displaceable between an unlocked position permitting the first latch to move between its locked and unlocked positions and a locked positions holding the first latch in its locked position.

6 Claims, 3 Drawing Sheets

CONNECTOR WITH DOUBLE-ACTION LATCH FOR A DIESEL-ENGINE GLOW PLUG

FIELD OF THE INVENTION

The present invention relates to a glow-plug connector. More particularly this invention concerns such a connector that can be latched to the glow plug.

BACKGROUND OF THE INVENTION

US patent publication 2005/0173395 describes a plug-in connector for a glow plug of a diesel engine. This plug-in connector is shaped to fit on a glow plug of a diesel engine, where both sides of the connection have several electrical contact areas which can be brought together. These contact areas form a connection for feeding power to the glow plug for firing the diesel engine and also form a connection for at least one sensor inside the glow plug. The sensor signals parameters, e.g. pressure or temperature, detected at the glow plug and transmits them for evaluation to n on-board computer that controls the diesel engine.

Providing such a plug-in connector for a glow plug with a sensor has the advantage that the installation is very compact, so that the unit consisting of plug-in connector, glow plug and sensor requires little space in or on the diesel engine. The detection of parameters in the area of the glow plug has the further advantage that combustion inside the diesel engine can be substantially better controlled or regulated, and exhaust emissions, noise, and the like of the diesel engine can be reduced to comply with today's especially strict environmental regulations. For this case it is especially important that the sensor signals from the glow plug be transmitted via the plug-in connector to the downstream controller.

Such a connector is subject to extremely high stress, especially with regard to temperature and vibrations in the area of the diesel engine, especially when used in a vehicle. Here, temperature variations of −40° C. to +150° C. are not unheard of. Further adverse conditions such as moisture, splashing water, dirt particles and the like are also a problem. Hence, it is of special importance that the plug-in connector on the one hand can be quickly and easily fitted toto the glow plug, to which end the plug-in connector is designed with a circular hole. On the other hand it is essential that the plug-in connector be fitted to the glow plug in a correct position to contact the several contact areas between plug-in connector and glow plug electrically with each other. Finally, it is critical that, once the plug-in connector has been fitted toto the glow plug in the correct position, this plug-in connector withstands the described environmental conditions and does not come loose from the glow plug.

OBJECTS OF THE INVENTION

It is therefore an object of the present invention to provide an improved connector for a motor-vehicle diesel-engine glow plug.

Another object is the provision of such an improved connector for a motor-vehicle diesel-engine glow plug that overcomes the above-given disadvantages, in particular that is particularly easy to fit to the glow plug, but that, once installed, stays solidly in place in spite of the difficult site conditions.

SUMMARY OF THE INVENTION

According to invention the plug-in connector has a primary latch or locking means for fixing the plug-in connector after fitting to the glow plug in the desired position and further has a secondary latch or locking means for fixing the primary locking means in the locked position. Thus, the primary locking means ensure that the plug-in connector is fixed in position after fitting to the glow plug, that is in the position in which the contact areas between the plug-in connector and glow plug have been contacted. Since, due to the rough environmental conditions and use conditions, especially vibrations in the area of the diesel engine, the danger still exists that the primary locking means move out of the locked position (and hence the plug-in connector detaches from the glow plug). Thus in an advantageous way the primary locking means are additionally secured by the secondary locking means. This is carried out in an advantageous way by a snap-fit connection that still allows the plug-in connector to be detached from the glow plug for repair. Nonetheless, with the system of the invention manipulation of the primary and secondary locking means to release them is such that to detach the two locking means high forces are required (especially in detaching the secondary locking means) that are not normally encountered in normal operation of the diesel engine. At this point it can be thought of to choose the secondary locking means or their locking forces such that on the one hand they withstand the forces arising in the operation of the diesel engine but on the other hand can be brought again into their starting or unlocked position through application of higher forces, for example by means of a tool.

According to further feature of the invention one or both of the locking means can be brought from their first unlocked position into the locked position by means of a longitudinal and/or rotational movement. In an especially advantageous way the locking of the locking means is carried out in the case of both via a longitudinal movement, wherein the locking means are designed such that in locking of the plug-in connector on the glow plug first the primary locking means can be brought from one of the positions to the other. During this movement the secondary locking means follow this movement. Only then is a longitudinal movement of the secondary locking means from the first unlocked position into the locked position possible, that is the primary locking means must have reached their locked position before the secondary locking means can be moved into its locked position.

BRIEF DESCRIPTION OF THE DRAWING

The above and other objects, features, and advantages will become more readily apparent from the following description, reference being made to the accompanying drawing in which.

SPECIFIC DESCRIPTION

Figures 1A, 1B, 1C:
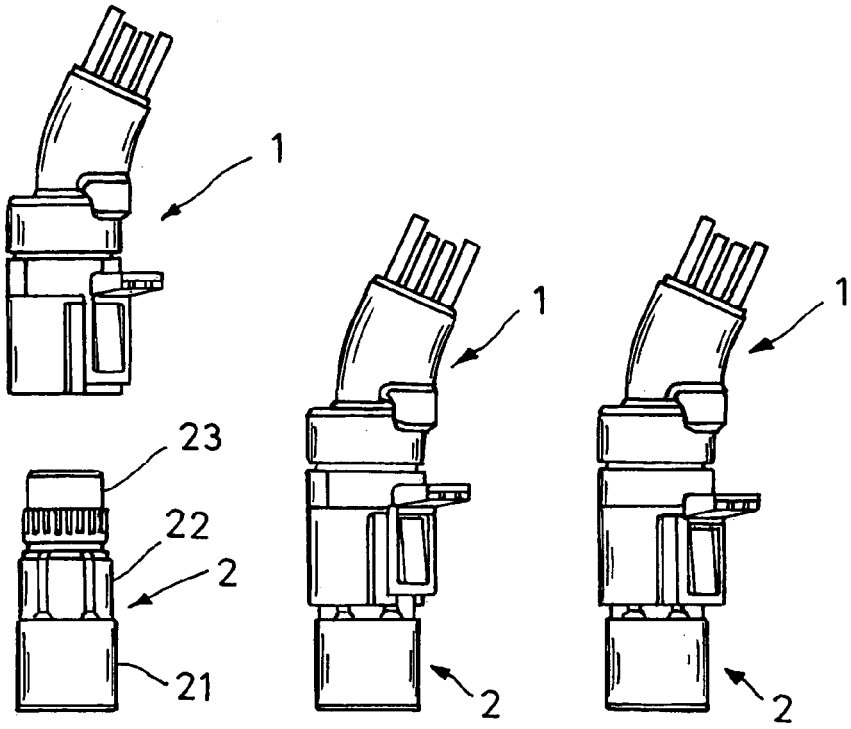
FIGS. 1A, 1B, and 1C show a plug-in connector for a glow plug in successive stages of installation.

FIGS. 1A–1C show, as far as shown in detail, a plug-in connector 1 having primary and secondary locking means to be described below. On its output side the plug-in connector 1 has a cable with several electrical conductors or several individual wires (as shown) to supply a glow plug 2 of the diesel engine with power for preheating and to transfer detected parameters in the area of the glow plug 2 to an unillustrated downstream controller. The glow plug 2 has, as far as shown in detail, a housing 21 to which a mounting region 22 by means of which the glow plug 2 can be mounted in the diesel engine. This mounting region 22 is formed for example as a hexagonal bolt. In the end area above the mounting area 22 and lying coaxially therein there is a contact area 23 where contacts can be operatively connected to contacts in the plug-in connector 1, if the plug-in connector 1 has been fitted to the glow plug.

Figure 2A:
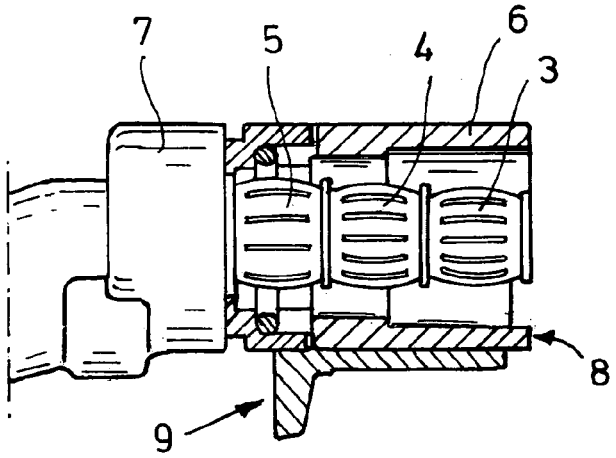
FIGS. 2A and 2*b* show in section the plug-in connector in the unplugged and plugged-in condition in section.
Figure 2B:
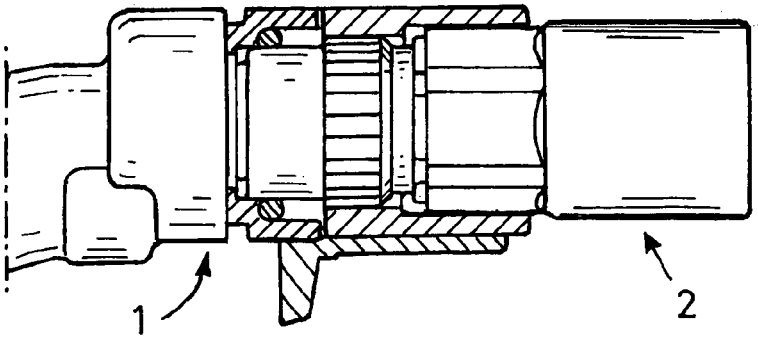

FIGS. 2A and 2B show the plug-in connector 1 and the glow plug 2 in section according to FIGS. 1A–1C. In FIG. 2A the plug-in connector 1 is shown in section with three contact areas 3 to 5. These contact areas 3 to 5 are formed for example as lamellar contacts, but other designs are within the scope of the invention. Further the plug-in connector 1 has a fixed housing sleeve 6 at the end of which a housing cap 7 forms the cable-side outgoing area of the plug-in connector 1. Further here longitudinally movable primary locking means 8 and also longitudinally movable secondary locking means 9 are present. In the detached condition of the plug-in connector 1 both locking means 8 are 9 are each present in an unlocked or first position in which they are set on manufacture or assembly. In an especially advantageous way the locking means 8 and 9 are designed such that they maintain this first unlocked position and can not be moved out from this position until the plug-in connector 1 has been fitted to the glow plug 2.

FIG. 2B shows the plug-in connector 1 after it has been fitted to the glow plug 2. In this representation the locking means 8 and 9 are both in their first unlocked position in which the position change and the locking of the plug-in connector 1 on the glow plug 2 resulting therefrom is described in the following.

FIGS. 3*a*–3*h* show a possibility of design of the primary and secondary locking means 8 and 9 as well as their mode of operation. FIGS. 3*a*–3*d* show the locking sequence of the primary locking means 8, and FIGS. 3*e*–3*h* show the locking sequence of the secondary locking means. However, these sequences of FIGS. 3*a*–3*d* as well as of FIGS. 3*e* to 3*h* do not run independently from each other but must take place in dependence on each other.

Figure 3:
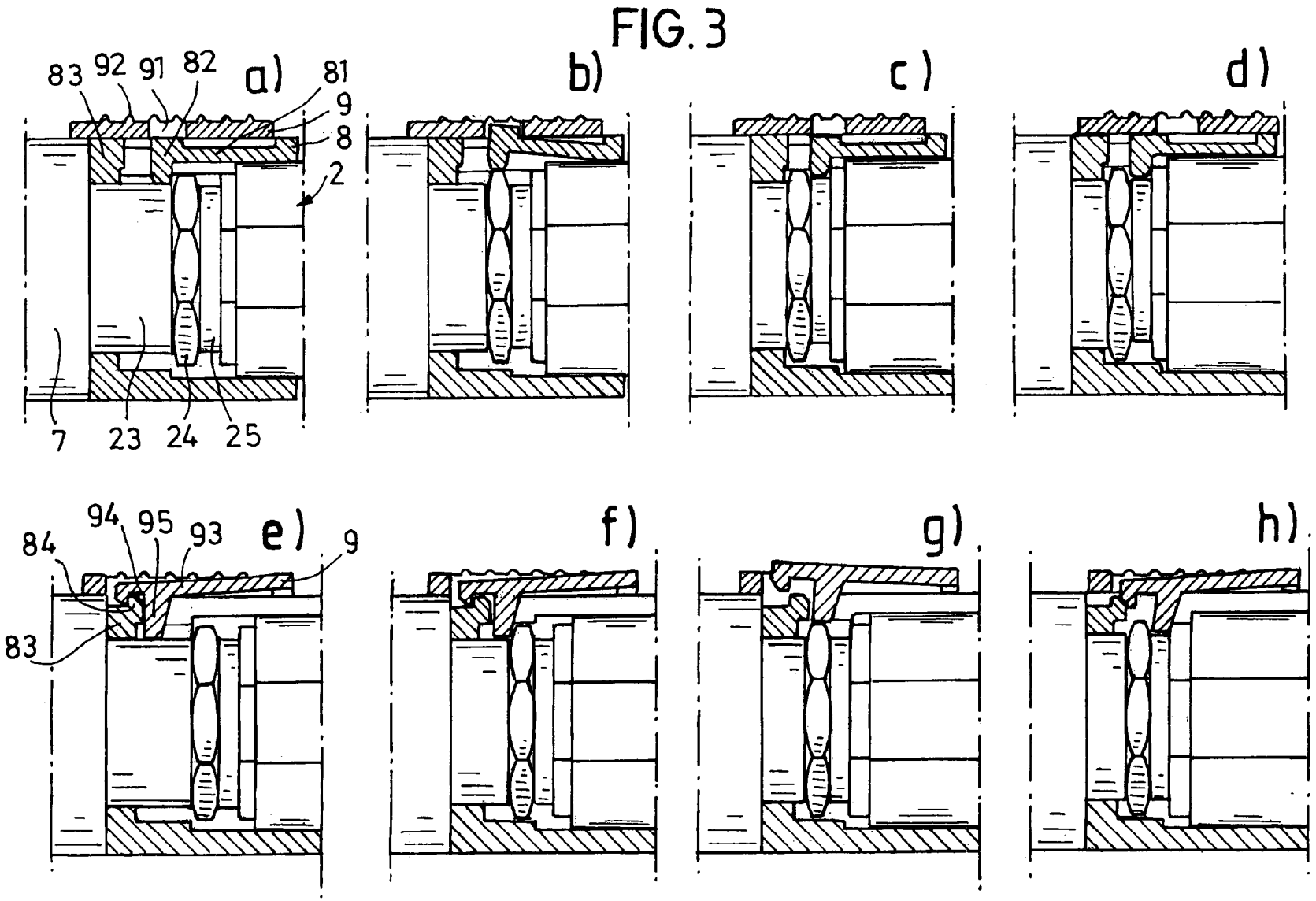
FIGS. 3*a*–3*h* illustrate the operation of the primary and secondary locking means according to invention.
Figure 4:
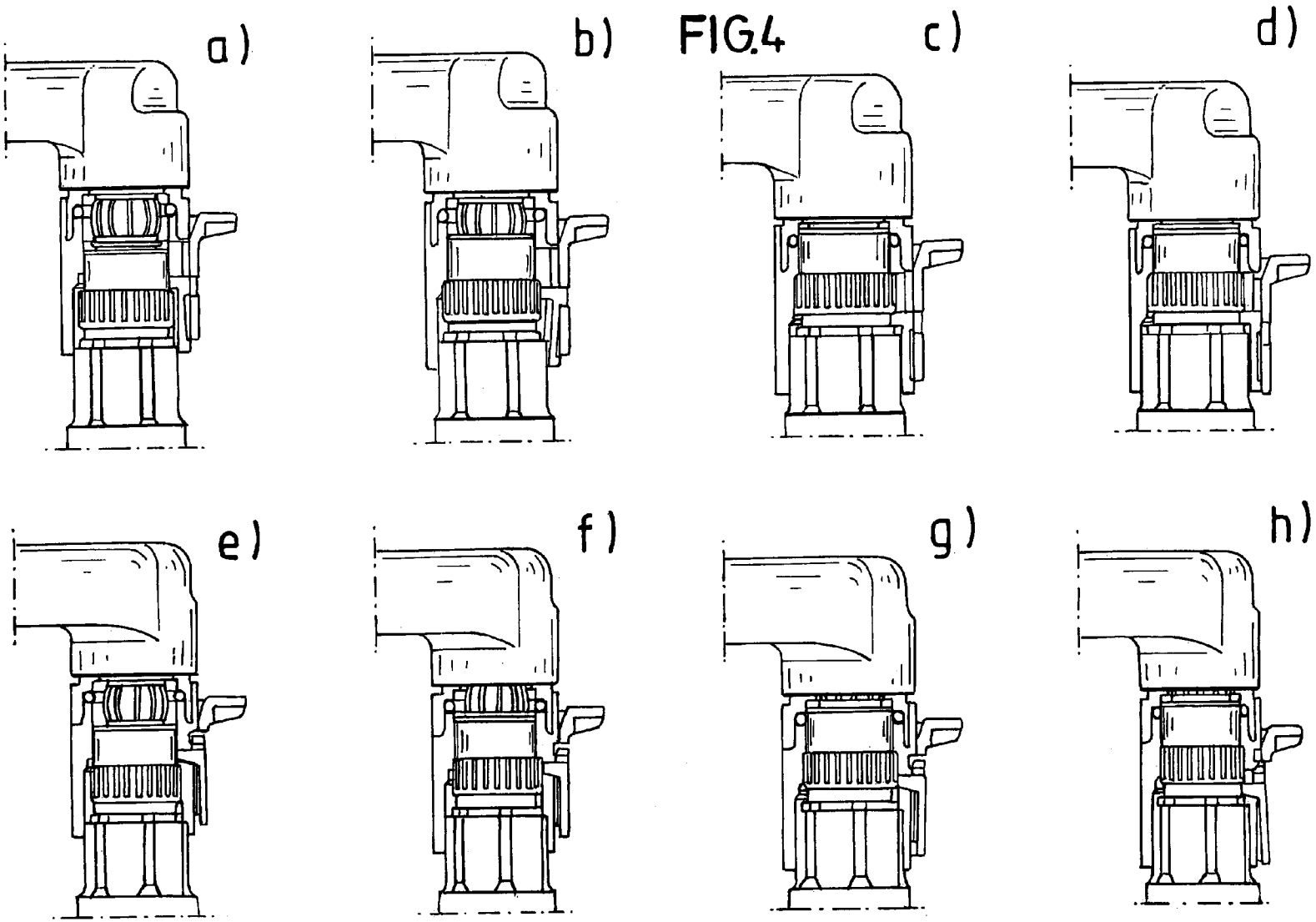
FIGS. 4*a*–4*h* show another design and mode of action of the primary locking means (FIGS. 4*a*–4*d*) and secondary locking means (FIG. 4*e*–4*h*) according to invention.

FIG. 3*a* shows that the primary locking means 8 has an arm 81 at the end of which a latch hook 82 is disposed. This latch hook 82 corresponds in the further locking sequence with a bar 24 and/or a groove 25 of the glow plug 2. Thus, according to the invention the primary locking means 8 has a latch hook 82 disposed on the arm 81, the latch hook 82 being made to work together with the bar 24 and/or groove 25 of the glow plug 2 in fitting to the plug-in connector 1 on the glow plug 2. With the previously described means the primary locking is attained. Further the primary locking means 8 also has a stop 83 as well as a further latch hook 84, the further latch hook 84 being disposed in the area of the stop 83.

The primary locking of the plug-in connector 1 on the glow plug 2 is carried out such that according to FIG. 3*a* the contact area 23 of the glow plug 2 is introduced in the housing sleeve 6 of the plug-in connector 1 with a longitudinal movement, i.e. the plug-in connector 1 is fitted to the glow plug 2. During this introduction, the bar 24 abuts the latch hook 82. With further introduction of the glow plug 2 into the plug-in connector 1 the latch hook 82 is detached from the bar 24 (FIG. 3*b*) and engages after further introduction into the groove 25 (FIG. 3*c*), where the latch hook 82 in the groove 25 completes the primary locking. To attain the desired positioning when fitting the plug-in connector 1 to the glow plug 2, the stop 83 engages the bar 24 (FIG. 3*c*), provided the plug-in connector 1 has been fitted to the glow plug 2 correctly.

FIG. 3*a* shows that the secondary locking means has a recess 91 for the latch hook 82. In the first locked position of both the primary locking means 8 and the secondary locking means 9, the latch hook 82 and recess 82 and recess 91 are complementary so that the latch hook 82 can engage on fitting the plug-in connector 1 to the glow plug 2 by movement of the arm 81 into this recess 91 (FIG. 3*b*) for the primary locking carried out by means of the latch hook 82. In this primary locking sequence of FIGS. 3*a* to 3*c* a position change between the locking means 8 and 9 does not take place. The primary locking means 9 has at its external surface several circumferential bars 92, which are advantageous for the manual position change described below, as therewith the secondary locking means 9 is better movable for the manual position change. This position change is shown in FIG. 3*d* in which the secondary locking means 8 has been moved longitudinally from its position into a second or end locked position. In this position the latch hook 82 of the primary locking means 8 and the recess 91 of the secondary locking means 9 are not congruent anymore such that the arm 81 is not movable anymore as the latch hook 82 is clamped between the inner side of the secondary locking means 9 and the bar 25 of the glow plug 2. In this position shown in FIG. 3*d* the secondary locking means 9 are also engaged detachably, the motion sequence of the secondary locking and its engagement being shown in FIGS. 3*e* to 3*h*.

In addition to the already described and shown elements of the locking means 8 and 9 the secondary locking means 9 has a latch hook 94 disposed on an arm 93, wherein the latch hook 94 is formed for acting together with the latch hook 84 of the primary locking means 8. Further the arm 93 carries a protrusion 95 extending toward the contact area 23 of the glow plug 2. In the first unlocked position of the locking means 8 and 9 the latch hook 84 and the latch hook 94 engage into each other such that it the secondary locking means 9 are maintained in a certain position relative to the primary locking means 8. When the plug-in connector 1 is fitted to the glow plug 2 the bar 24 slides over the protrusion 95 such that the arm 93 is moved. This is shown in FIG. 3*g*. This movement of the arm 93 additionally detaches the latch hook 94 from the latch hook 84 such that the next position is attained FIGS. 3*c* and 3*g*.

Here the plug-in connector 1 is fitted to the glow plug 2 in the correct position and the primary locking (engagement of the latch hook 82 into the groove 25 and attachment of the bar 24 at the stop 83) has taken place (FIG. 3*c*). For additional locking of the primary locking means 8, the secondary locking means 9 is now moved longitudinally from its first unlocked position (FIGS. 3*c* and 3*g*) to its further locked position. After this longitudinal movement the primary locking means 8 is thereby locked in that the recess 91 of the secondary locking means 9 is not congruent with the latch hook 82 of the primary locking means (FIG. 3*d*) anymore. The position fixing or locking of the secondary locking means 9 takes thereby place by detachment of the arm 93 the latch hooks 84 and 94 with longitudinal sliding of the secondary locking means 9 in the direction of the glow plug 2 up to the point until the protrusion 95 at the arm 93 is also positioned in the groove 25 of the glow plug 2 (see FIG. 3*h*).

FIGS. 4*a*–4*h* show a further design and mode of operation of the primary and secondary locking means according to the invention, wherein the plug-in connector 1 and glow plug 2 are merely rotated through 90° and only vary slightly from FIG. 3*a*–3*h*. The design and mode of operation of the locking means 8 and 9 is however the same.

We claim:

1. In combination with a diesel-engine glow plug, a plug-in connector comprising:

a housing centered on an axis and fittable with the glow plug;

a plurality of contacts in the housing;

first locking means on the housing displaceable when the housing is fitted to the glow plug between an unlocked position for permitting the housing to be installed on and removed from the glow plug and a locked position for fixing the housing to the glow plug; and second locking means on the housing displaceable between an unlocked position for permitting the first locking means to move between its locked and unlocked positions and a locked positions holding the first locking means in its locked position.

2. The combination defined in claim 1 wherein at least one of the locking can be moved from its locked position to its unlocked position by longitudinal or rotation movement.

3. The combination defined in claim 1 wherein the secondary locking means are formed such that they are movable from the unlocked position into the locked only when the plug-in connector has been fitted to the glow plug in the correct position and the primary locking means have been brought from its unlocked position into its locked position.

4. The combination defined in claim 3 wherein the primary locking means has a latch hook disposed on an arm, the latch hook being formed for working together with a formation groove of the glow plug on fitting of the plug-in connector to the glow plug.

5. The combination defined in claim 4 wherein the secondary locking means has a recess for working together with the latch hook.

6. The combination defined in claim 4, wherein the secondary locking means has a latch hook disposed on an arm, the latch hook being formed for working together with a latch hook of the primary locking means.

* * * * *

UNITED STATES PATENT AND TRADEMARK OFFICE

CERTIFICATE OF CORRECTION

PATENT NO. : 7,165,982 B2
APPLICATION NO. : 11/390959
DATED : January 23, 2007
INVENTOR(S) : Jürgen Häfele et al.

It is certified that error appears in the above-identified patent and that said Letters Patent is hereby corrected as shown below:

Title Page, Item (73), should read
(73) Assignee: Hirschmann Automotive GmbH
Rankweil/Brederis (AT)

Signed and Sealed this

Third Day of April, 2007

JON W. DUDAS
*Director of the United States Patent and Trademark Office*